US011248419B2

(12) United States Patent
Maouche et al.

(10) Patent No.: US 11,248,419 B2
(45) Date of Patent: Feb. 15, 2022

(54) HYBRID DRILL BIT

(71) Applicant: Halliburton Energy Services, Inc., Houston, TX (US)

(72) Inventors: Zakaria Maouche, The Woodlands, TX (US); Mohammad Amro, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 76 days.

(21) Appl. No.: 16/790,858

(22) Filed: Feb. 14, 2020

(65) Prior Publication Data

US 2021/0254410 A1 Aug. 19, 2021

(51) Int. Cl.
*E21B 10/14* (2006.01)
*E21B 10/42* (2006.01)
*E21B 10/567* (2006.01)

(52) U.S. Cl.
CPC ..... *E21B 10/14* (2013.01); *E21B 10/42* (2013.01); *E21B 10/567* (2013.01)

(58) Field of Classification Search
CPC ..... E21B 10/14
See application file for complete search history.

(56) References Cited

U.S. PATENT DOCUMENTS 3,174,564 A * 3/1965 Morlan ..... E21B 10/14 175/405.1
8,336,646 B2 12/2012 Kulkarni
9,869,133 B2 * 1/2018 Chen ..... E21B 10/633
10,107,039 B2 10/2018 Schroder
10,190,366 B2 1/2019 Zahradnik et al.
10,458,188 B2 * 10/2019 Bomidi ..... E21B 10/627
10,472,899 B2 * 11/2019 Shi ..... B23P 15/28
10,557,311 B2 2/2020 Anderle et al.
10,760,342 B2 * 9/2020 Hinz ..... E21B 10/54
2008/0017419 A1 * 1/2008 Cooley ..... E21B 10/62 175/286
2012/0273281 A1 * 11/2012 Burhan ..... E21B 10/573 175/431

(Continued)

FOREIGN PATENT DOCUMENTS

CN 106368615 9/2019
EP 0162107 11/1985

(Continued)

OTHER PUBLICATIONS

BHI-GE, Kymera/Hybrid Bit.

*Primary Examiner* — Blake Michener
(74) *Attorney, Agent, or Firm* — Thomas Rooney; C. Tumey Law Group PLLC

(57) ABSTRACT

A hybrid drill bit includes a bit body having a plurality of fixed cutters disposed thereon and at least one rolling-cutter pocket. The hybrid drill bit further includes a rolling cutter rotatably positioned within the rolling-cutter pocket on the bit body. The rolling cutter includes a roller body with an axial bore and a plurality of teeth arranged around the roller body to engage a subterranean formation. Additionally, the hybrid drill bit includes a rolling cutter retention mechanism including a pin received within the axial bore of the rolling cutter, the pin engaging the bit body to rotatably couple the rolling cutter within the rolling-cutter pocket in the bit body.

20 Claims, 11 Drawing Sheets

(56) References Cited

U.S. PATENT DOCUMENTS

| | | | | |
|---|---|---|---|---|
| 2013/0313021 | A1* | 11/2013 | Zahradnik | E21B 10/28 175/57 |
| 2014/0326515 | A1* | 11/2014 | Shi | E21B 10/08 175/365 |
| 2015/0233185 | A1 | 8/2015 | Maouche et al. | |
| 2016/0153243 | A1* | 6/2016 | Hinz | E21B 10/633 175/57 |
| 2016/0230467 | A1* | 8/2016 | Zahradnik | E21B 10/18 |
| 2016/0273273 | A1* | 9/2016 | Hinz | E21B 10/43 |
| 2017/0058609 | A1 | 3/2017 | Chen et al. | |
| 2018/0202231 | A1 | 7/2018 | Anderle et al. | |
| 2019/0003259 | A1 | 1/2019 | Grosz | |
| 2019/0032419 | A1* | 1/2019 | Chen | E21B 12/00 |
| 2019/0249498 | A1* | 8/2019 | Hinz | E21B 10/633 |
| 2020/0318438 | A1* | 10/2020 | Grosz | E21B 10/14 |

FOREIGN PATENT DOCUMENTS

| | | |
|---|---|---|
| EP | 3146137 | 9/2019 |
| WO | 2019094011 | 5/2019 |

* cited by examiner

HYBRID DRILL BIT

BACKGROUND

Various types of tools are used to form wellbores in subterranean formations for recovering hydrocarbons such as oil and gas lying beneath the surface. Examples of such tools include rotary drill bits, hole openers, reamers, and coring bits. One common type of rotary drill bit used to drill wellbores is known as a fixed-cutter drill bit. Generally, fixed-cutter drill bits include polycrystalline diamond ("PDC") cutters fixed to leading faces of the fix-cutter drill bit.

In conventional wellbore drilling, a fixed-cutter drill bit is mounted on the end of a drill string, which may be several miles long. At the surface of the wellbore, a rotary table or top drive may turn the drill string, including the drill bit arranged at the bottom of the hole to penetrate the subterranean formation. As the fixed-cutter drill bit rotates, the PDC cutters may shear the subterranean formation.

However, PDC cutter may experience increase wear during drill operations in some subterranean formations. For example, heterogeneous and/or nodular subterranean formations (e.g., chert) may cause breakage and/or delamination of PDC cutters, which may lead to the development of ring out or core out wear in the fixed-cutter drill bit. Such wear to the PDC cutters and/or the fixed-cutter drill bit may hinder the efficiency of drilling operations.

BRIEF DESCRIPTION OF THE DRAWINGS

These drawings illustrate certain aspects of some examples of the present disclosure and should not be used to limit or define the disclosure.

DETAILED DESCRIPTION

Disclosed are a hybrid drill bit having a fixed-cutter bit body, having a plurality of fixed cutters and at least one rolling cutter disposed thereon. Aspects of the disclosure include particular rolling cutter retention mechanisms for rotatably securing the rolling cutter to the fixed-cutter type bit body. The inclusion of a rolling cutter on an otherwise fixed-cutter drill bit to form a hybrid drill bit may, for example, reduce breakage, delamination, or other wear of the fixed cutters, which may extend an operational life of the drill bit. The disclosed rolling cutter retention mechanisms facilitate manufacturing of the hybrid drill bit, including the installation of the rolling cutter.

Figure 1:
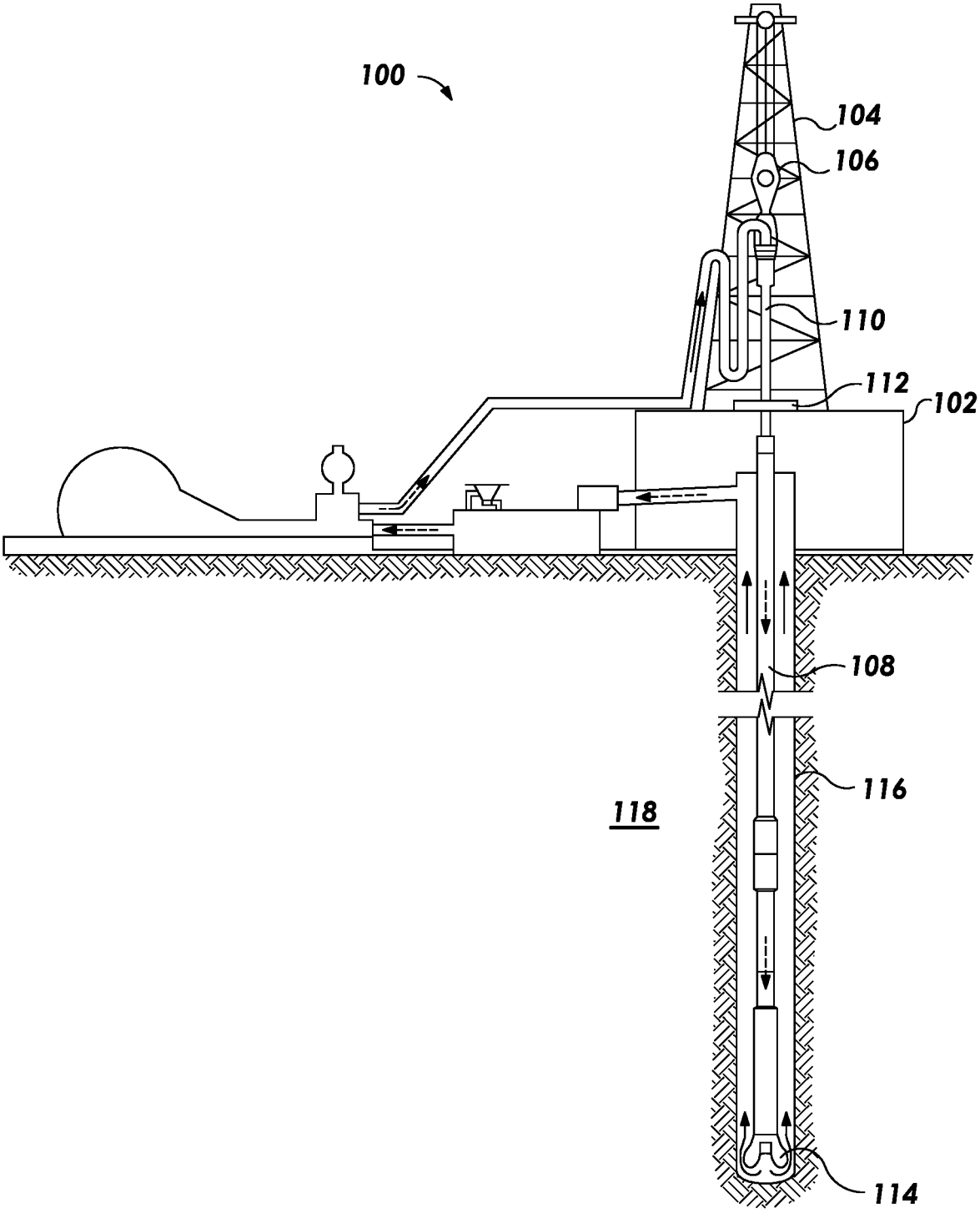
FIG. 1 illustrates a side elevation, partial cross-sectional view of an operational environment for a drilling system in accordance with one or more embodiments of the disclosure.

FIG. 1 is a side elevation, partially cross-section view of an operational environment for a drilling system in accordance with one or more embodiments of the disclosure. While FIG. 1 generally depicts a land-based drilling assembly, those skilled in the art will readily recognize that the principles described herein are equally applicable to subsea drilling operations that employ floating or sea-based platforms and rigs, without departing from the scope of the disclosure. As illustrated, the drilling assembly 100 may include a drilling platform 102 that supports a derrick 104 having a traveling block 106 for raising and lowering a drill string 108. The drill string 108 may include, but is not limited to, drill pipe and coiled tubing, as generally known to those skilled in the art. A kelly 110 is lowered through a rotary table 112 and is used to transmit rotary motion from the rotary table to the drill string 108. A hybrid drill bit 114 is attached to the distal end of the drill string 108 and is driven by a downhole motor and/or via rotation of the drill string 108. As the hybrid drill bit 114 rotates, it creates a wellbore 116 that penetrates various subterranean formations 118.

Figure 2:
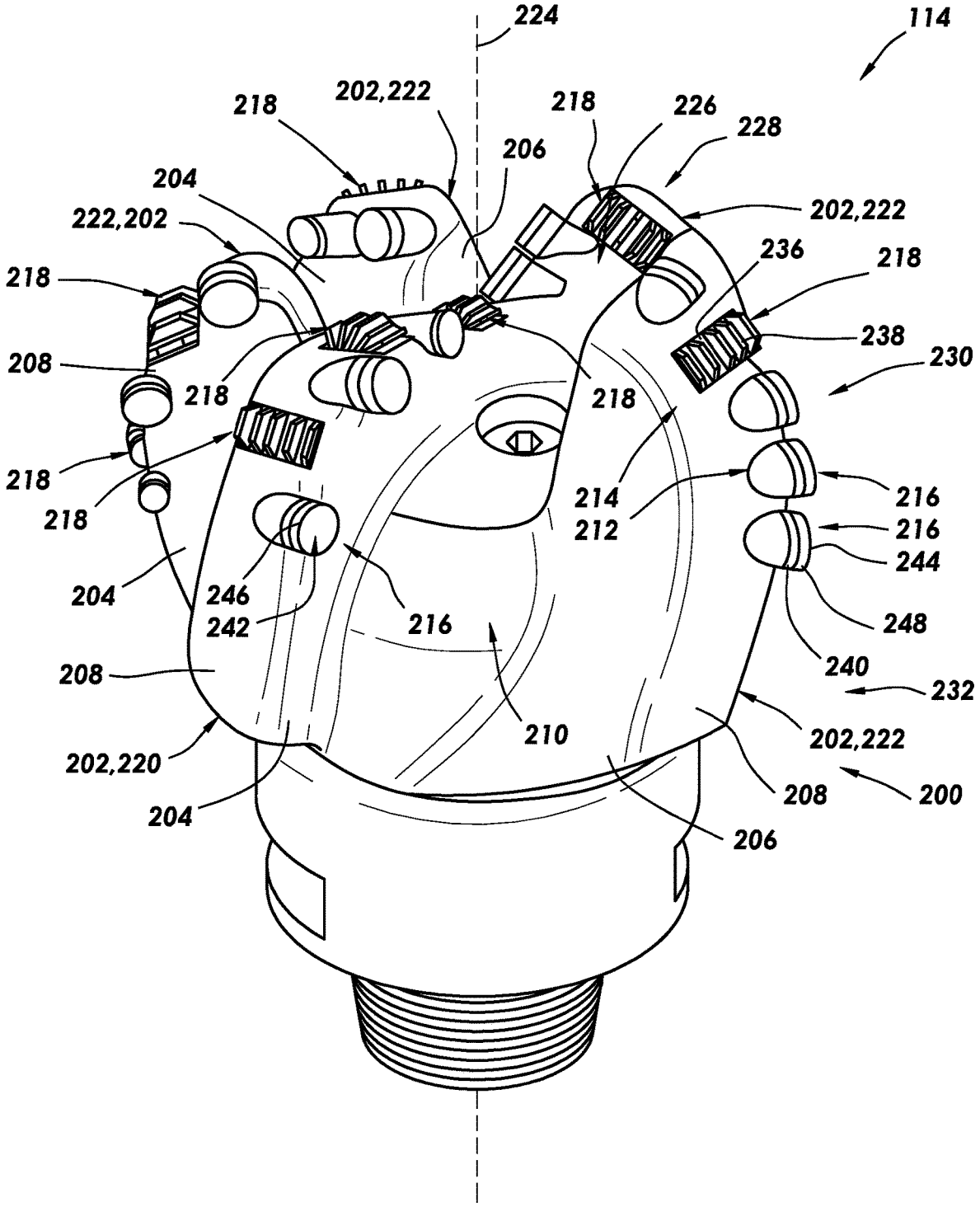
FIG. 2 illustrates a perspective view of an embodiment of a hybrid drill bit that may employ the principles of the present disclosure.

FIG. 2 is a perspective view of an embodiment of a hybrid drill bit 114 employing the principles of the present disclosure. The hybrid drill bit 114 has a plurality of fixed cutters 216 and three rolling cutters 218 to penetrate the various subterranean formations 118. Although as few as one rolling cutter may be included and would still be beneficial, multiple rolling cutters will typically be included, such as for more evenly balanced force distribution and for increased wear resistance. Generally, the fixed cutters 216 are positioned about the bit body at very particular locations and angular positions to shear the various subterranean formations 118 as a drill bit rotates. The fixed cutters 216 will eventually wear or fail over time given the harsh environment and conditions of cutting through solid rock under tremendous force and temperature. Examples of such wear include the development of ring out or core out wear in the traditional fixed-cutter type drill bit.

To reduce such wear to the fixed cutters, and prolong the bit life, the hybrid drill bit 114 includes the rolling cutters 218 at strategic locations on the bit body. The rolling cutters 218 may crush the various subterranean formations 118 as the hybrid drill bit 114 rotates. The rolling cutters 218 may be positioned to crush the various subterranean formations 118 ahead of the fixed cutters 216, which may generally be less harsh on the fixed cutters 216 as compared with solid rock, leading to a reduced wear rate and extended life of the hybrid drill bit 114.

Still referring to FIG. 2, the hybrid drill bit 114 has a generally fixed-cutter type bit body 200. A fixed-cutter type bit body may be made of a steel or metal-matrix composite of a harder material (e.g., tungsten carbide reinforcing particles dispersed in a binder alloy). Further, the bit body 200 may include at least one radially and longitudinally extending blade 202 having a leading face 204, a trailing face 206, and an exterior face 208. The at least one blade 202 includes a plurality of blades spaced apart from each other on the exterior of the bit body 200, which arrangement provides fluid flow paths (e.g., junk slots 210) between adjacent blades 202.

The bit body 200 includes a plurality of fixed-cutter pockets 212 for receiving the fixed cutters 216, and a rolling-cutter pocket 214 formed in an exterior surface of the bit body 200 for receiving the rolling cutter 218. Each fixed-cutter pocket 212 is shaped and positioned to receive an end of a respective one of the fixed cutters 216, which may be a circular end of a generally cylindrical fixed cutter. The fixed cutters 216 may each have a central axis that by virtue of its placement in the corresponding fixed-cutter pocket 212 may be generally transverse to a generally circular overall profile of the blades 202 swept by the bit body 200 as it rotates, to orient a cutting edge 244 of the fixed cutter 216 for a particular angle of engagement with the formation to be cut. Each rolling-cutter pocket 214 may be shaped or otherwise configured to receive a respective one of the rolling cutters 218 with a rotational axis oriented differently than that of the central axis of the fixed cutters 216. The rotational axis of the rolling cutters 218 may be generally tangent to the generally circular overall profile of the bit body 200, such that the roller body 236 rolls generally flat along the borehole being drilled, or as further described below. The fixed-cutter pockets 212 and the rolling-cutter pockets 214 may be formed in the blades 202. In particular, the fixed-cutter pockets 212 and the rolling-cutter pockets 214 may individually be formed in the exterior face 208 of the blade 202, the leading face 204 of the blade 202, the trailing face 206 of the blade 202, or some combination thereof.

Each fixed cutter 216 may be rigidly secured within the fixed-cutter pocket 212, such as by brazing the end of the fixed cutter 216 into the fixed-cutter pocket 212. The fixed cutters 216 are therefore fixed in position and do not move relative to the bit body 200. The rolling cutter 218, conversely, is rotatably secured within the rolling-cutter pocket 214 with a rolling cutter retention mechanism 234 as set forth in greater detail below.

The radially and longitudinally extending blades 202 include at least one primary blade 220 and at least one secondary blade 222. The primary blade 220 may extend from a central axis 224 of the hybrid drill bit 114. The secondary blade 222 may include any other blade 202 of the hybrid drill bit 114 that does not extend from the central axis 224 of the hybrid drill bit 114. Although the illustrated embodiment shows the hybrid drill bit 114 having two primary blades 220 and three secondary blades 222 by way of example, the hybrid drill bit 114 may include any number of primary blades 220 or secondary blades 222 insofar as those blades may be fit on the bit body. During drilling operations, the primary blade 220 may be configured to support a majority of the weight-on-bit, which may cause the fixed cutter 216 disposed on the primary blade 220 to wear faster than other fixed cutters of the fixed cutter 216 disposed on the secondary blade 222. Thus, the rolling cutter 218 may be rotatably coupled to the primary blade 220 to reduce wear on the fixed cutter 216 disposed on the primary blade 220. In particular, a rolling cutter 218 may be rotatably coupled to the rolling-cutter pocket 214 formed in the primary blade 220. Alternatively, or in addition, a rolling cutter 218 may be rotatably coupled to the rolling-cutter pocket 214 formed in the secondary blade 222. A plurality of rolling cutters 218 may even be disposed in the primary blade 220 and/or the secondary blade(s) 222.

During drilling operations, a cone area 226 of the hybrid drill bit 114 may support at least a portion of the weight-on-bit. The cone area 226 may support a majority of the weight-on-bit, such that the fixed cutters 216 disposed in the cone area 226 may wear faster than other of the fixed cutters 216 disposed at a nose area 228, a shoulder area 230, or a gauge area 232 of the bit body 200. To reduce wear on the fixed cutters 216, one or more of the rolling cutters 218 may be disposed within the cone area 226 of the hybrid drill bit 114. However, the rolling cutters 218 may be disposed within any area of the hybrid drill bit 114. For example, the hybrid drill bit 114 may include a plurality of rolling cutters 218 disposed along the radially and longitudinally extending blade 202. The plurality of rolling cutters 218 may alternate with a plurality of fixed cutters 216 along the radially and longitudinally extending blade 202, which may reduce wear to the plurality of fixed cutters 216.

The rolling cutters 218 in this example each include a roller body 236 and a plurality of teeth 238 disposed around the roller body 236. The plurality of teeth 238 may be secured to and/or formed on the roller body 236 using any suitable manufacturing method, such as milled into the roller body 236 or as inserts secured to the roller body 236. The plurality of teeth 238 may include an extremely hard material (e.g., tungsten carbide), and may include any material suitable for operation in extreme downhole conditions. The teeth 238 engage the subterranean formations 118 (e.g., shown on FIG. 1). Specifically, as the hybrid drill bit 114 is rotated, the rolling cutter 218 is configured to rotate about a central axis (e.g., central axis 506 on FIG. 5B) of the rolling cutter 218 to, via weight-on-bit, sequentially force each tooth of the plurality of teeth 238 into the subterranean formations 118, which may crush at least a portion of the subterranean formations 118. The rolling cutter 218 may be configured to rotate based at least in part on contact with the subterranean formations 118. The rolling cutter 218 may be oriented to roll along the subterranean formations 118 as the hybrid drill bit 114 rotates.

Moreover, the rolling cutters 218 may be positioned to provide depth-of-cut control for the hybrid drill bit 114. That is, based at least in part on the shape, size, and positioning of the rolling cutters 218 on the hybrid drill bit 114, the rolling cutters 218 may control an amount of the subterranean formations 118 that the fixed cutters 216 cuts or otherwise engages. The roller body 236 and the plurality of teeth 238 may be configured to provide a desired depth-of-cut for the hybrid drill bit 114. Additionally, the rolling cutters 218 may be positioned on the hybrid drill bit 114 to provide the desired depth-of-cut for the hybrid drill bit 114.

Figure 4:
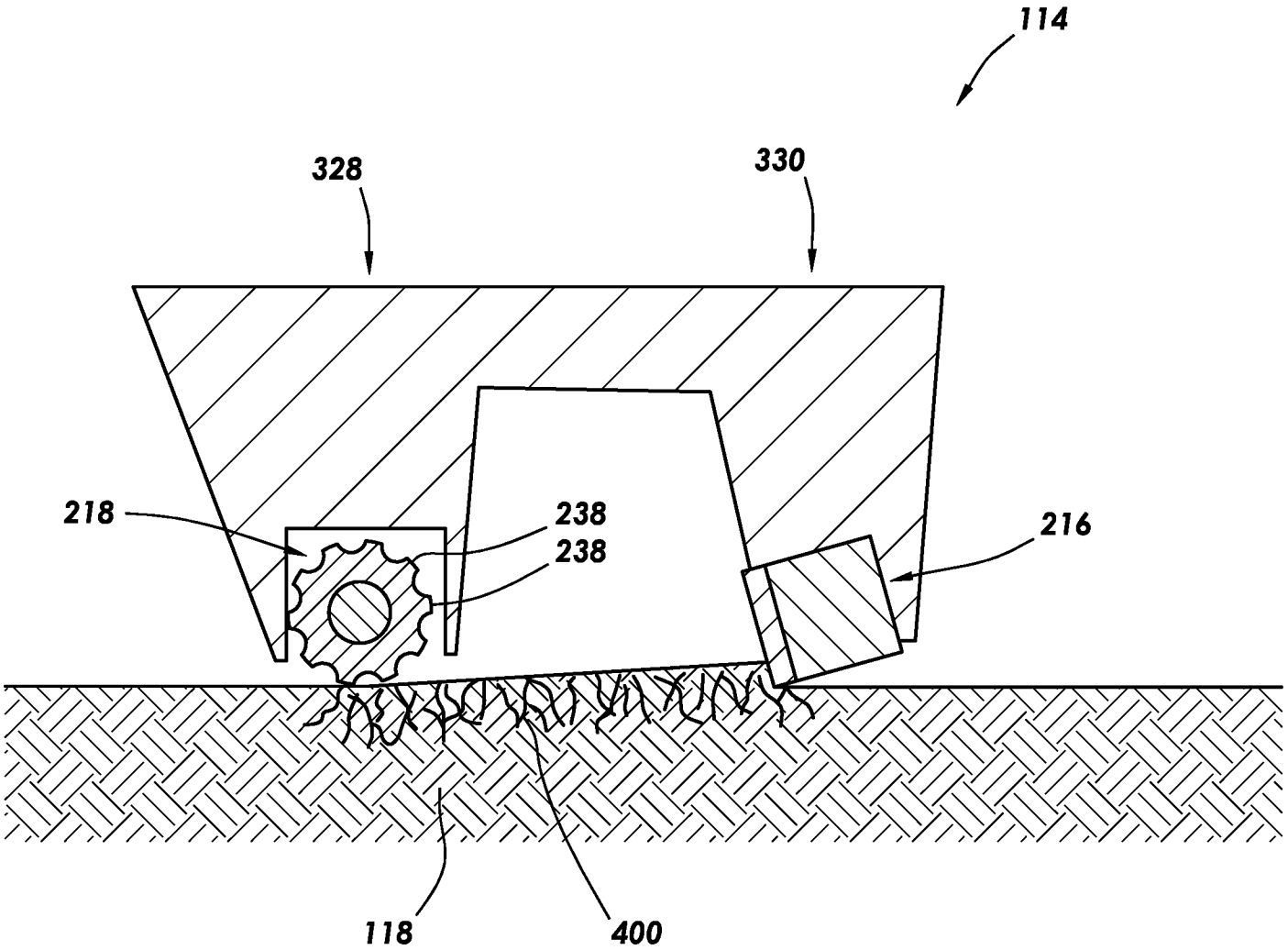
FIG. 4 illustrates a cross-sectional view of the hybrid drill bit of FIG. 2 in accordance with some embodiments.

As indicated above, each of the fixed cutters 216 will typically be secured within its respective fixed-cutter pocket 212 via brazing. Alternatively, the fixed cutters 216 may be secured at least partially within the respective fixed-cutter pocket 212 via threading, shrink-fitting, press-fitting, or any other suitable manufacturing or assembly method for fixedly securing the fixed cutters 216 to the bit body 200 such that the fixed cutter does not prove with respect to the bit body 200 even while drilling. Each of the fixed cutters 216 may be secured within the fixed-cutter pocket 212 at a predetermined angular orientation to position the fixed cutter 216 at a desired angle with respect to the subterranean formations 118 (as best shown in FIG. 4) being penetrated. As the hybrid drill bit 114 is rotated, the fixed cutter 216 is driven through the subterranean formation 118 by the combined forces of the weight-on-bit and the torque experienced at the hybrid drill bit 114 to shear the various subterranean formations 118.

The fixed cutters 216 may each include a substrate 240 made of an extremely hard material (e.g., tungsten carbide) and a cutter 242 secured to the substrate 240, the fixed cutters 216 may each include one or more layers of an ultra-hard material, such as polycrystalline diamond, polycrystalline cubic boron nitride, impregnated diamond, etc., which generally forms a cutting edge 244 and a working face 246 for each cutter 242. The working face 246 is typically flat or planar but may also exhibit a curved exposed surface that meets a side surface 248 at the cutting edge 244. To form the cutter 242, the substrate 240 may be placed adjacent a layer of ultra-hard material particles, such as diamond or cubic boron nitride particles, and the combination is subjected to high temperature at a pressure where the ultra-hard material particles are thermodynamically stable. This results in recrystallization and formation of a polycrystalline ultra-hard material layer, such as a polycrystalline diamond or polycrystalline cubic boron nitride layer, directly onto the upper surface of the substrate.

Figure 3:
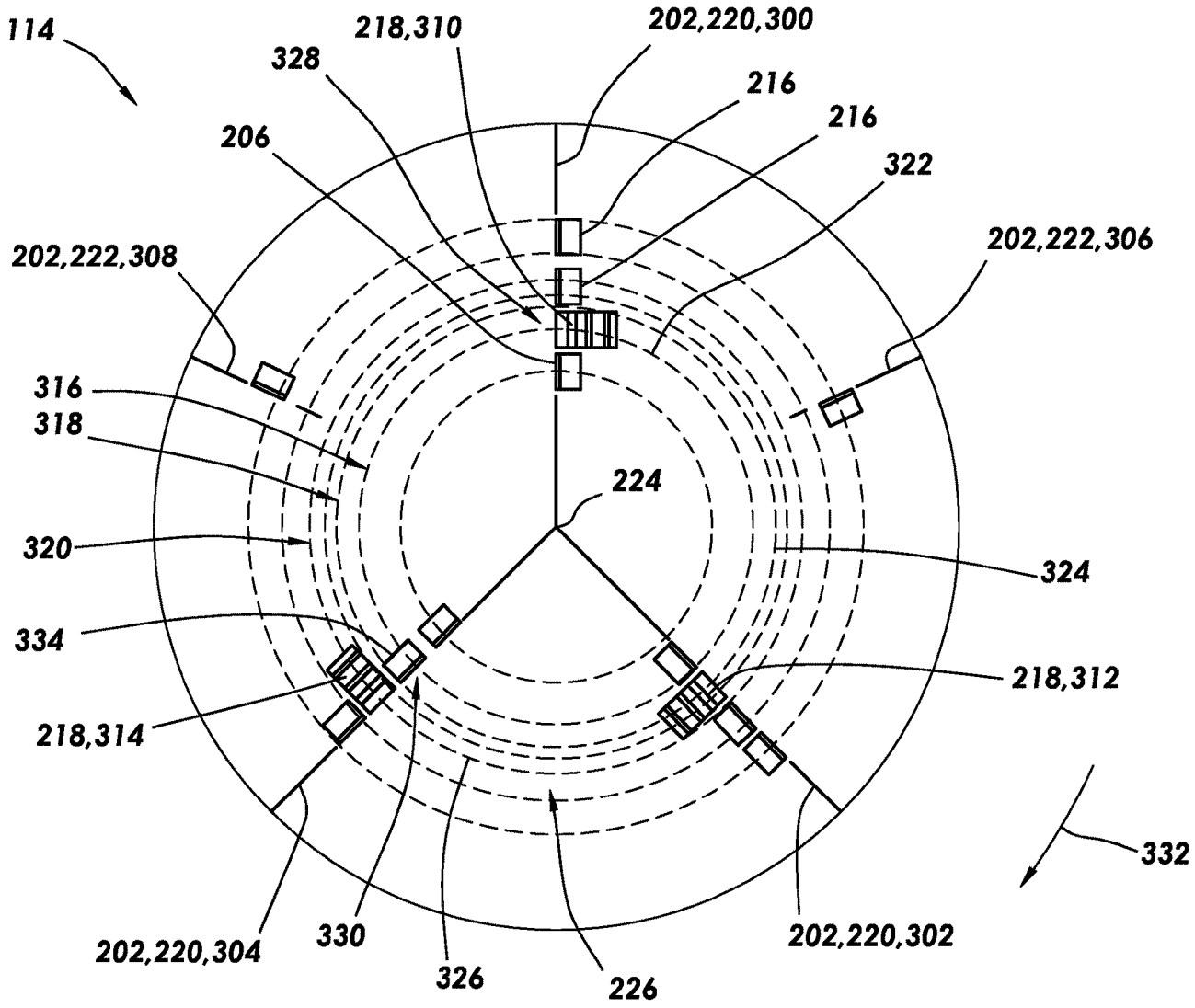
FIG. 3 illustrates a schematic view of the hybrid drill bit of FIG. 2 in accordance with some embodiments.

FIG. 3 illustrates a schematic view of cutter placement for the hybrid drill bit 114 of FIG. 2 in accordance with some embodiments. As set forth above, the hybrid drill bit 114 includes the primary blade 220 extending from the central axis of the hybrid drill bit 114 and the secondary blade 222. As illustrated, the primary blade 220 includes a first primary blade 300, a second primary blade 302, and a third primary blade 304. Further, the secondary blade 222 includes a first secondary blade 306 and a second secondary blade 308. Moreover, the hybrid drill bit 114 includes the rolling cutters 218 disposed on the blade 202. By way of example, the rolling cutters 218 may be disposed in primary blade 220 and/or secondary blade 222. In the illustrated embodiment, the rolling cutters 218 includes a first rolling cutter 310 disposed on the first primary blade 300, a second rolling cutter 312 disposed on the second primary blade 302, and a third rolling cutter 314 disposed on the third primary blade 304. Each of the rolling cutters 218 may be positioned between adjacent fixed cutters 216 along the respective primary blade 220 (e.g., the first primary blade 300, the second primary blade 302, and the third primary blade 304).

The rolling cutters 218 may be circumferentially arranged about the bit body 200 and are optionally evenly circumferentially spaced. Each of the rolling cutters 218 may be disposed at a unique radial position or distance from the central axis 224 of the hybrid drill bit 114. For example, the first rolling cutter 310 may be disposed at a first radial position 316, the second rolling cutter 312 may be disposed at a second radial position 318, and the third rolling cutter 314 may be disposed at a third radial position 320. Each radial position (e.g., the first radial position 316, the second radial position 318, and the third radial position 320) may be disposed within the cone area 226 of the hybrid drill bit 114. Moreover, the first radial position 316 may be disposed closer to the central axis 224 than the second radial position 318 and the third radial position 320. Further, the third radial position 320 may be disposed further away from the central axis 224 than the first radial position 316 and the second radial position 318. Accordingly, each rolling cutter 218 may follow a unique cutting path (e.g., a first cutting path 322, a second cutting path 324, and a third cutting path 326) as the hybrid drill bit 114 rotates. The unique cutting paths may orbit the central axis of the hybrid drill bit 114 at a substantially constant distance.

The rolling cutters 218 and the fixed cutters 216 may be disposed along the same cutting path as defined by rotation of the hybrid drill bit around the hybrid drill bit's own axis of rotation. The rolling cutters 218 may be disposed in a leading position 328 and the fixed cutters 216 may be disposed in the trailing position 330. As in the illustrated embodiment, the hybrid drill bit 114 may rotate in a clockwise direction 332. Thus, in one example, the first rolling cutter 310 may be in the leading position 328 and a first fixed cutter 334 may be in the trailing position 330. As set forth in detail below, the first rolling cutter 310 in the leading position 328 may engage the subterranean formations 118 prior to the first fixed cutter 334 in the trailing position 330 to reduce wear on the first fixed cutter 334.

FIG. 4 illustrates a cross-sectional view of the hybrid drill bit 114 of FIG. 2 in an example configuration. As set forth above, the rolling cutter 218 may be positioned in the leading position 328 on the hybrid drill bit 114 and the fixed cutter 216 may be disposed in a trailing position 330 on the hybrid drill bit 114. The rolling cutter 218 in the leading position 328 may be configured to engage the subterranean formations 118 prior to the fixed cutter 216 in the trailing position 330 engaging the subterranean formations 118. The plurality of teeth 238 of the rolling cutter 218 are configured to crush the subterranean formation 118. Crushed subterranean formation 400 may cause less wear to the fixed cutter 216. Thus, the rolling cutter 218 may be positioned in the leading position 328 on the hybrid drill bit 114 and the fixed cutter 216 may be disposed in a trailing position 330 to reduce wear on the fixed cutter 216 and/or the hybrid drill bit 114.

Figure 5A:
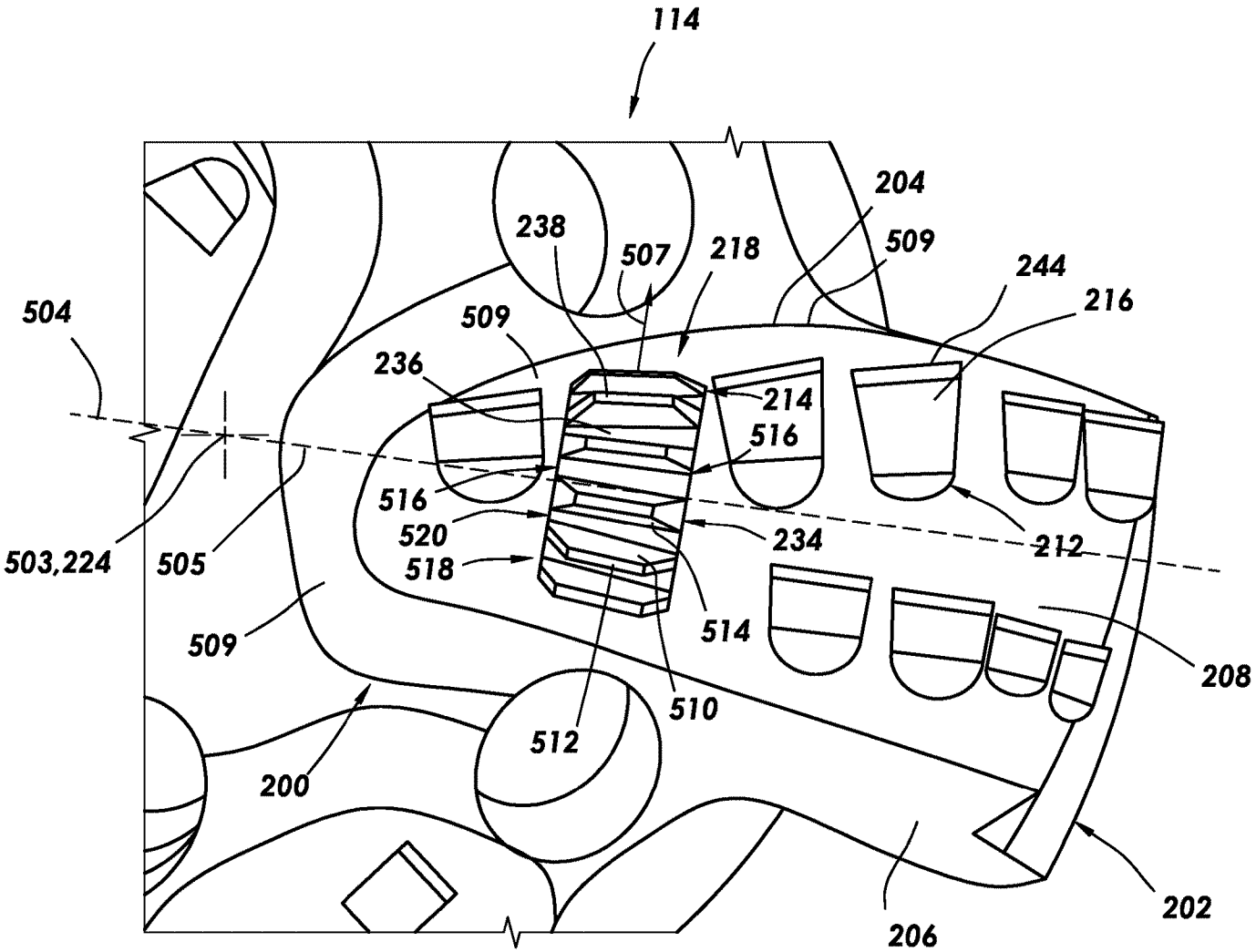
FIG. 5A illustrates a three-dimensional perspective view of the hybrid drill bit further comparing the rolling cutter and fixed cutters including their relative orientations.

FIG. 5A is a three-dimensional perspective view of the hybrid drill bit 114 further comparing the rolling cutter 218 and fixed cutters 216 including their relative orientations. Each fixed cutter 216 is fixed within its respective fixed-cutter pocket 212 such that the cutting edge 244 of each fixed cutter 216 will engage the formation at a desired angle of engagement. These positions may be precisely and individually selected in the design of the fixed cutter portion of the hybrid drill bit 144 as generally understood in the fixed cutter drill bit art apart from the specific details disclosed herein. By comparison, the roller body 236 of the rolling cutter 218 is oriented such that it will roll against the borehole being drilled into the formation 118. In this example, to facilitate rolling the roller body 236 flat against the formation 118, the rotational axis 505 (e.g., central axis 504) of the roller body 236 is oriented generally tangent to an approximately spherical or otherwise rounded profile swept by an outer surface 509 of the blade 202 as the bit 114 rotates during drilling. In this example, to facilitate rolling, the rotational axis 505 of the roller body 236 is also oriented generally inward toward a rotational axis 503 (e.g., central axis 224) of the drill bit 114, which is generally perpendicular with a tangential direction of movement 507 of the roller body 236 about the rotational axis 503 of the drill bit 114.

Figure 5B:
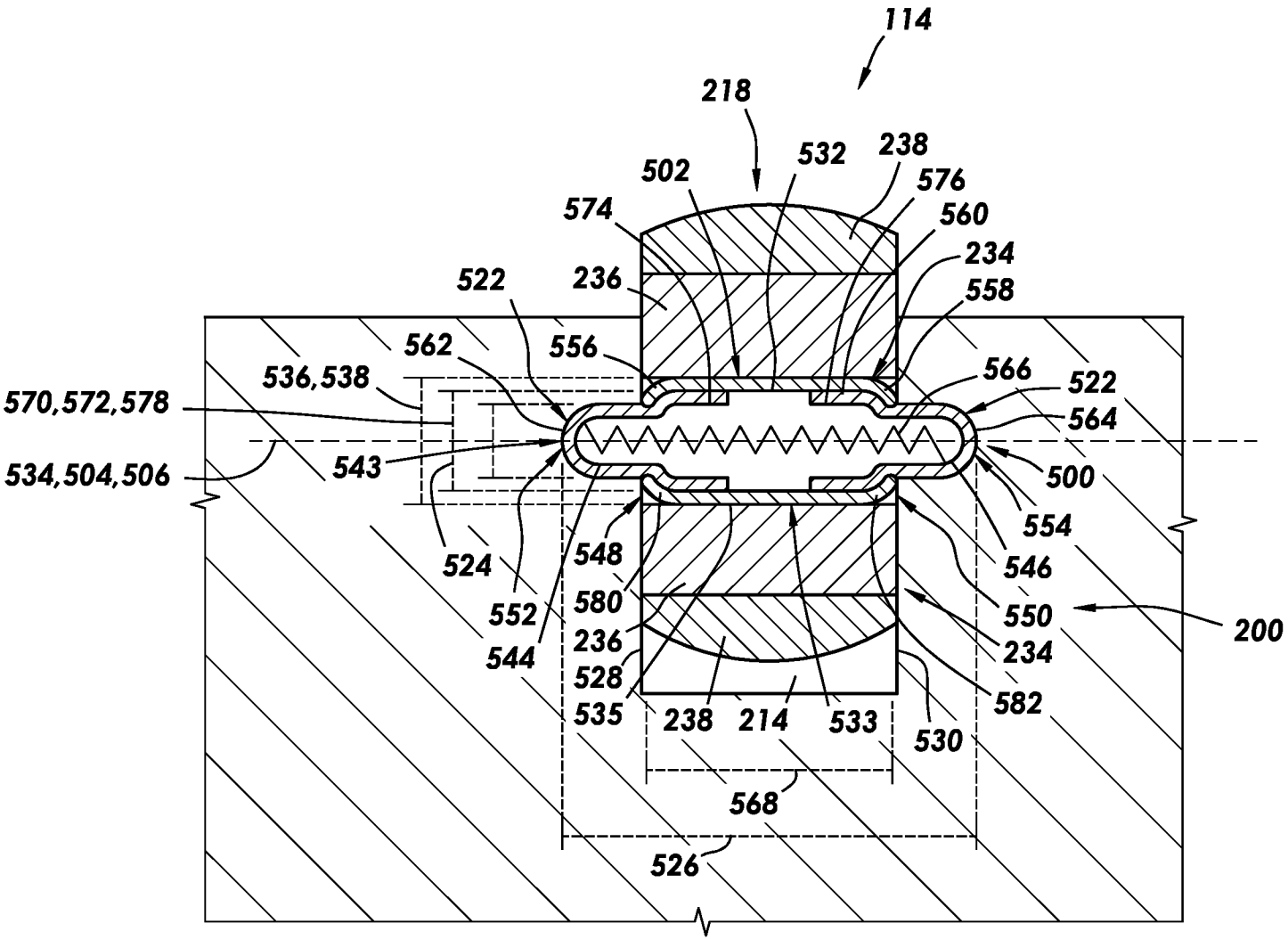
FIG. 5B illustrates a cross-sectional view of the hybrid drill bit further detailing an example of the rolling cutter and a rolling cutter retention mechanism having a pin.

FIG. 5B is a cross-sectional view of the hybrid drill bit 114 further detailing an example of the rolling cutter 218 and a rolling cutter retention mechanism 234 having a pin 500.

The roller body 236 of the rolling cutter 218, in this example, includes an axial bore 502 through a central axis 504 of the roller body 236. The central axis 504 of the roller body 236 and a central axis 506 of the rolling cutter 218 are coaxial. Each tooth 238 on the roller body 236 may extend radially outward from the central axis 506 along an axial length 508 of the rolling cutter 218. The plurality of teeth 238 may be disposed around the roller body 236 at equal intervals. For example, the plurality of teeth 238 may be disposed at intervals of 30°, 40°, 60°, or any other suitable interval. Alternatively, the plurality of teeth 238 may be disposed at unequal intervals. Each tooth 238 may include a leading working face 510, a radial working face 512, and a trailing working face 514. The rolling cutter 218 may further include a plurality of grooves 516 disposed between adjacent teeth of the plurality of teeth 238. Each groove of the plurality of grooves 516 may be disposed between the leading work face 510 of a first tooth 518 and the trailing work face 514 of a second tooth 520. The rolling-cutter pocket 214 is sized to receive the rolling cutter 218 (with the teeth exposed above the blade for engagement of the roller teeth with the wellbore).

The overall rolling cutter retention mechanism 234, and the pin 500 itself in this embodiment, may have any of a variety of different configurations within the scope of this disclosure. The rolling cutter retention mechanism 234 in this example includes a pin 500 that may be secured by its ends to the bit body 200, which may both rotatably secure the roller body 236 to the drill bit body and function as a bearing to facilitate rolling. The pin 500 itself may include multiple components that may be assembled during manufacture and/or in replacing or repairing a worn rolling cutter 218. The rolling cutter retention mechanism 234 in this embodiment further includes a pin bore 522 disposed within the rolling-cutter pocket 214 to receive and support the pin 500 at least at the ends of the pin 500. A diameter 524 of the pin bore 522 may have a constant diameter. However, the diameter of the pin bore 522 may have vary along an axial length 526 of the pin bore 522. Alternatively, the pin bore 522 may have a non-circular cross section (e.g., oval-shaped, polygonal, non-uniform). Further, in the illustrated embodiment, the pin bore 522 extends into opposing first 528 and second 530 sides of the rolling-cutter pocket 214. In the illustrated embodiment, the pin bore 522 does not extend through any face of the blade (e.g., the leading face 204, the trailing face 206, and the exterior face 208).

The roller body 236 may be configured to rotate around the pin body 532, and a central axis 534 of the pin body 532 may be coaxial with the central axis 506 of the rolling cutter 218. The pin body 532 may include an outside diameter 536 substantially equal to an inside diameter 538 of the roller body 236. The pin body 532 may be configured extend through an axial length 540 of the roller body 236. That is, an axial length 542 of the pin body 532 substantially equal to the axial length of the roller body 236. Alternatively, the axial length 542 of the pin body 532 may be less than the axial length 540 of the roller body 236.

The pin 500 may include a hollow pin body 532 wherein an interior portion may house one or more components of the retention mechanism 234. The one or more components of the retention mechanism 234 may include at least one axially reciprocal member, referred to herein as plunger 543, that plunges outward from the hollow pin body 532. In this example, the pin 500 includes a first plunger 544 and a second plunger 546 disposed within the hollow pin body 532. The first and second plungers 544, 546 may protrude from the hollow pin body 532 at opposing ends 548 and 550 of the hollow pin body 532. The first plunger 544 and the second plunger 546 are constrained by the hollow pin body 532 to move axially in the hollow pin body 532, for example, along a central axis. That is, as the first plunger 544 and the second plunger 546 are positioned within the hollow pin body 532, and respective outer diameters 570, 572 of respective axially interior portions 574, 576 of the first plunger 544 and the second plunger 546 are similar to an inner diameter 578 of the hollow pin body 532, the hollow pin body 532 restrains radial movement of the first plunger 544 and the second plunger 546. However, opposing ends 580, 582 of the hollow pin body 532 are open to allow axial movement of the plungers 544, 646 in the hollow pin body 532. The plungers 544, 546 extend outwardly of the hollow pin body 532 at distal ends 552 and 554 of the plungers 544, 546 for engagement with the bit body 200, such as with corresponding pin receptacles 562, 564 on the bit body 200. The pin receptacles 562, 564 may be defined by the bit body 200 on opposing sides of the pin bore 522. The hollow pin body 532 may include a first lip 556 and a second lip 558 to retain at least a portion of the first plunger 544 and the second plunger 546 (e.g., respective proximal portions 560 of the first plunger 544 and the second plunger 546) within the hollow pin body 532. Moreover, the first distal end 552 and the second distal end 554 of the first plunger 544 and the second plunger 546, respectively, may extend axially outward to secure the rolling cutter 218 within the pin bore 522. The first plunger 544 and the second plunger 546 may be axially and radially secured within the pin receptacles, shown as first pin receptacle 562 and second pin receptacle 564. The first plunger 544 and the second plunger 546 may also be rotationally secured within the first and second pin receptacles 562, 564 The first distal end 552 and the second distal end 554 of the first plunger 544 and the second plunger 546, respectively, may be shaped to fit within the first and second pin receptacles 562, 564. For example, the first distal end 552 may include anon-circular cross section (e.g., oval-shaped, polygonal, non-uniform) corresponding to a cross-section of a first pin receptacle 562 of the pin bore 522. Further, the second distal end 554 may include a circular cross-section of substantially similar diameter to a diameter of a circular cross-section of a second pin receptacle 564 of the pin bore 522. The first distal end 552 and the second distal end 554 of the first plunger 544 and the second plunger 546, respectively, may have similar cross-sections.

The ends of the pin 500 may be secured to the bit body 200 in any of a variety of ways. To facilitate engagement with the bit body 200, the pin 500 includes an optional biasing mechanism 566 to bias the first plunger 544 and the second plunger 546 axially outward from the hollow pin body 532 in opposing directions of the hollow pin body 532 (e.g., along the central axis 534) to secure the pin 500 to the pin bore 522 disposed within the rolling-cutter pocket 214 during drilling operations. The biasing mechanism 566 may include any suitable mechanism for biasing the first plunger 544 and the second plunger 546. For example, the biasing mechanism 566 may include a compression spring. The compression spring may be configured to provide a constant load resistance. However, the compression spring may include any diameter, spring coil thickness, shape (e.g., constant, barrel, conical), material (e.g., stainless-steel), or other suitable characteristic for biasing the first plunger 544 and the second plunger 546.

During installation of the rolling cutter 218, the biasing mechanism 566 may be configured to compress such that each end of the biasing mechanism 566 is disposed within the axial bore 502 of the roller body 236. Further, the first plunger 544 and the second plunger 546 may be configured to compress axially inward such that the first distal end 552 and the second distal end 554 of the first plunger 544 and the second plunger 546, respectively, are fully housed within the hollow pin body 532. Compressing the first plunger 544 and the second plunger 546 axially inward may compress the biasing mechanism 566. As set forth above, the axial length 542 of the hollow pin body 532 may be equal to or less than the axial length 540 of the roller body 236. Further, a width 568 of the rolling-cutter pocket 214 may be substantially equal to the axial length 540 of the roller body 236. As such, during installation, the first distal end 552 and the second distal end 554 of the first plunger 544 and the second plunger 546, respectively, may be compressed within the roller body 236 such that the rolling cutter 218 may slide into the rolling-cutter pocket 214 without catching on the pin 500. Further, during installation, the biasing mechanism 566 may bias the first distal end 552 and the second distal end 554 of the first plunger 544 and the second plunger 546, respectively, axially outward such that the first distal end 552 and the second distal end 554 slide axially outward into the first and second pin receptacles 562, 564 of the pin bore 522 when the pin 500 is aligned with the pin bore 522.

Alternatively, the rolling cutter 218 may include a bearing mechanism disposed between the pin 500 and the rolling cutter 218. The bearing mechanism may include ball bearings, roller bearings, or some combination thereof. The bearing mechanism may be disposed between the hollow pin body 532 and the roller body 236.

Figure 6A:
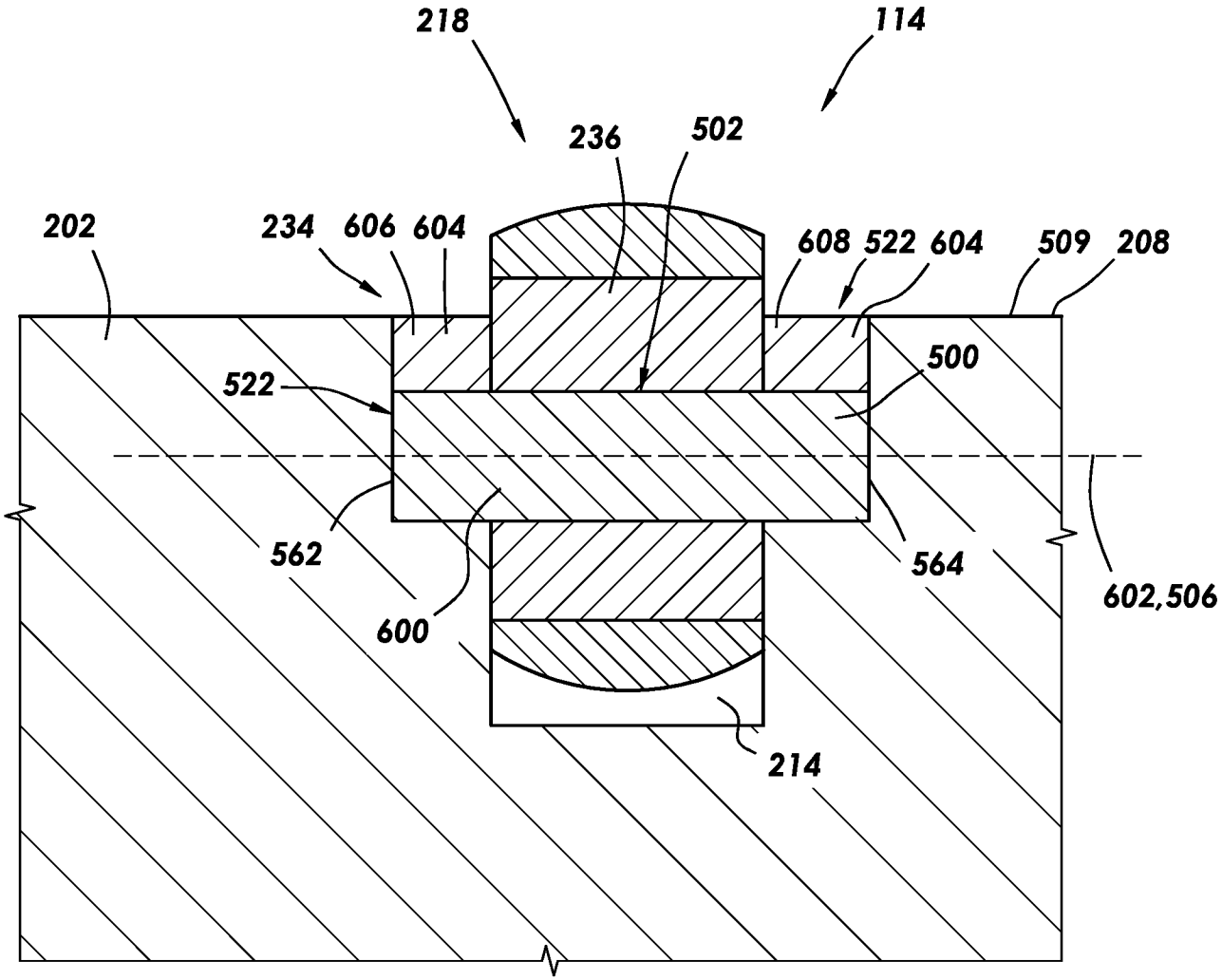
FIG. 6A illustrates a cross-sectional view of the hybrid drill bit further detailing an example of the rolling cutter and the rolling cutter retention mechanism having a pin.

FIG. 6A is a cross-sectional view of the hybrid drill bit 114 further detailing an example of the rolling cutter 218 and the rolling cutter retention mechanism 234 having a pin 500. As set forth above, the pin 500 rotatably couples the rolling cutter 218 to the blade 202 of the hybrid drill bit 114. In particular, the pin 500 may be configured to rotatably couple the rolling cutter 218 to the rolling-cutter pocket 214 formed in the blade. In the illustrated embodiment, the rolling-cutter pocket 214 is formed in the exterior face 208 of the blade. The rolling-cutter pocket 214 may be sized to receive at least a portion of the rolling cutter 218.

Further, the rolling-cutter pocket 214 may include a pin bore 522 disposed within at least a portion of the rolling-cutter pocket 214 and configured to receive the pin 500. The pin bore 522 may extend into opposing first and second sides of the rolling-cutter pocket 214 from an outer surface 509 of the blade 202 of the bit body 200. In the illustrated embodiment, the pin bore 522 extends through the exterior face 208 of the outer surface 509 of the blade 202.

Moreover, in the illustrated embodiment, the pin 500 includes a solid pin body 600 positioned within the pin bore 522. While not shown, the pin 500 may alternatively include the hollow pin body 532 for receiving the at least one axially movable plunger 543 as set forth above in FIGS. 5A and 5B. The pin 500 engages a portion of the bit body 200 positioned within the pin bore 522 to rotatably couple the rolling cutter 218 within the rolling-cutter pocket 214. That is, at least a portion of the solid pin body 600 is positioned within the axial bore 502 of the roller body 236. The pin 500 extends from the first pin receptacle 562 of the pin bore 522, through the axial bore 502 of the roller body 236, and to the second pin receptacle 564 of the pin bore 522. The roller body 236 rotates around the solid pin body 600, and a central axis 602 of the solid pin body 600 may be, for example, coaxial with the central axis 506 of the rolling cutter 218.

During installation of the rolling cutter 218, the pin 500 may be inserted through the roller body 236. Moreover, as the pin bore 522 extends through the exterior face 208 of the blade 202, the rolling cutter 218 and the pin 500 may slide into the exposed rolling-cutter pocket 214 and pin bore 522. To prevent the pin 500 from falling out of the pin bore 522, the rolling cutter 218 may include at least one plug 604 inserted into the pin bore 522 between the pin 500 and the exterior face 208 of the blade 202. The plug 604 may be welded or otherwise secured within the pin bore 522. In the illustrated embodiment, the plug includes a first plug piece 606 and a second plug piece 608. The first plug piece 606 is inserted into the pin bore 522 proximate the first pin receptacle 562 of the pin bore 522 at a position between the pin 500 and the exterior face 208 of the blade 202. Further the second plug piece 608 is inserted into the pin bore 522 proximate the second pin receptacle 564 of the pin bore 522 at a position between the pin 500 and the exterior face 208 of the blade 202.

Figure 6B:
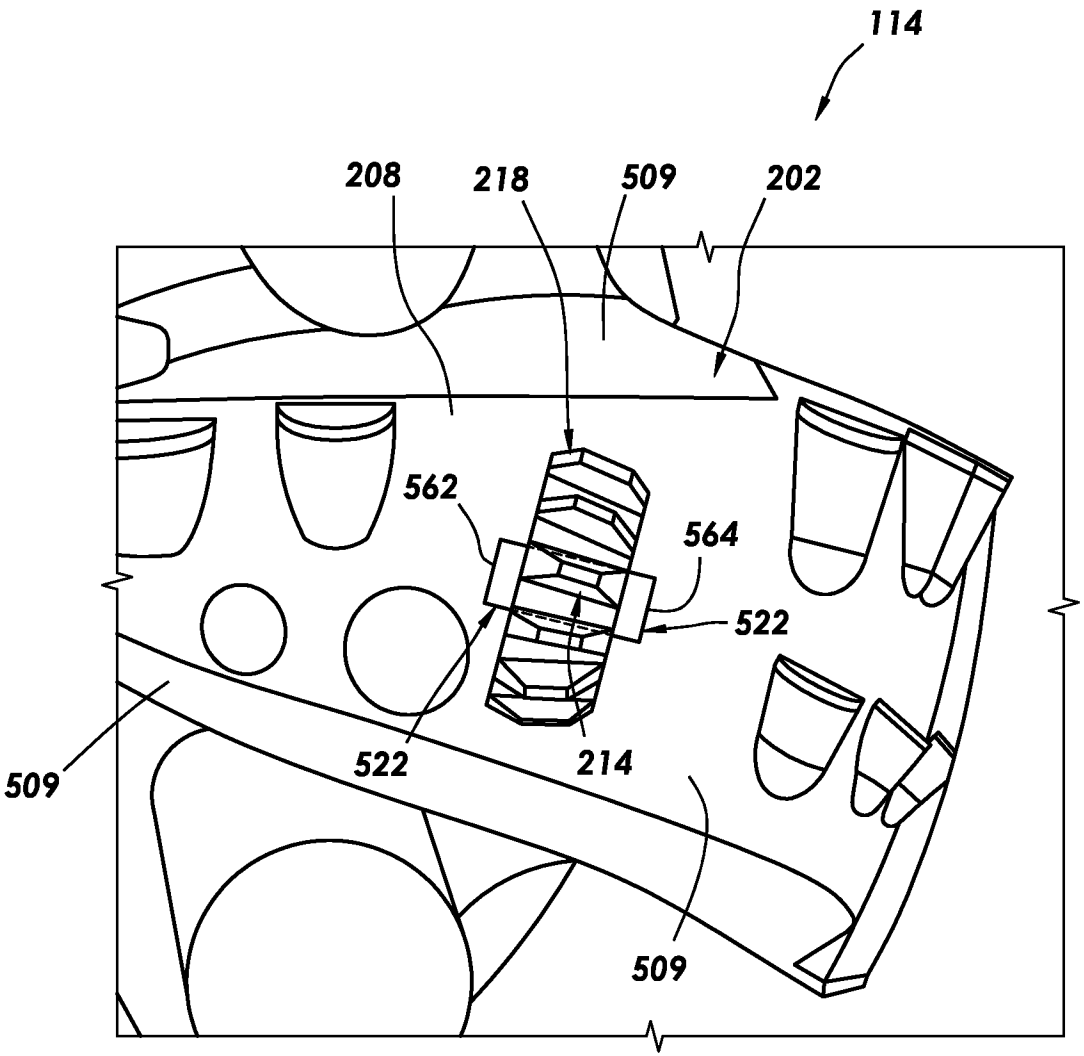
FIG. 6B illustrates a three-dimensional perspective view of the rolling cutter and the rolling cutter retention mechanism.

FIG. 6B is a three-dimensional perspective view of the rolling cutter 218 and the rolling cutter retention mechanism 234. As illustrated in FIG. 6A, the rolling cutter 218 includes the pin bore 522 extends through the exterior face 208 of the outer surface 509 of the blade 202. The pin 500 is inserted through the roller body 236 and inserted into the pin bore to rotatably couple to the rolling cutter within the rolling-cutter pocket 214. To prevent the pin 500 from falling out of the pin bore 522, the rolling cutter 218 may include at least one plug 604 inserted into the pin bore 522 between the pin 500 and the exterior face 208 of the blade 202.

Figure 7B:
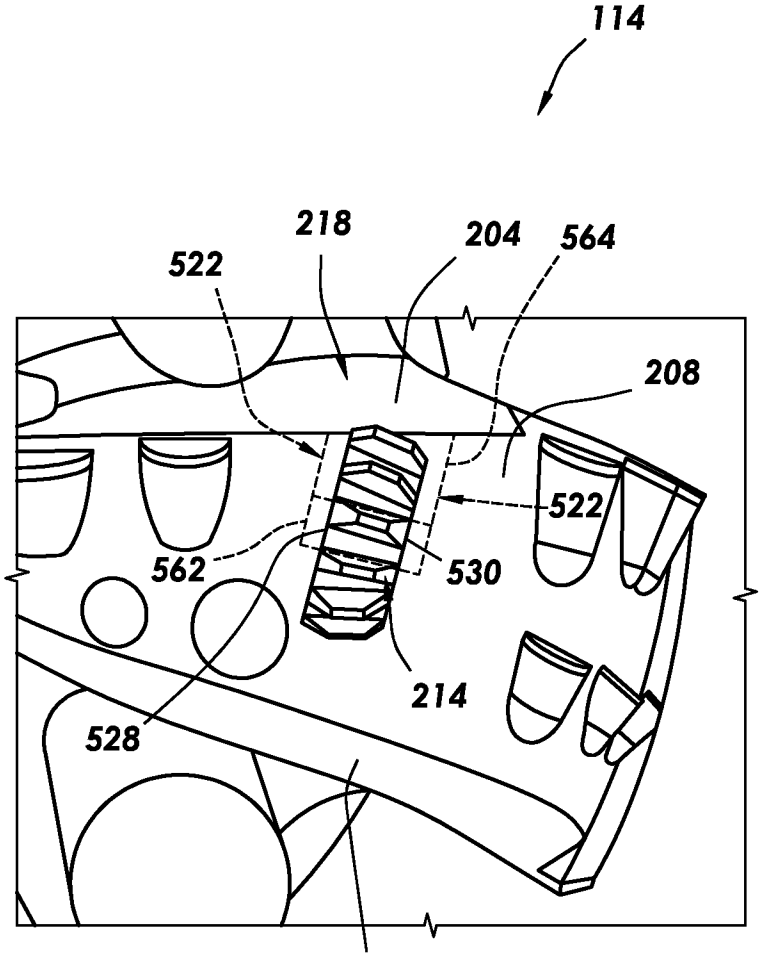
FIG. 7B illustrates a three-dimensional perspective view of the rolling cutter with yet another embodiment of a rolling cutter retention mechanism.
Figure 7A:
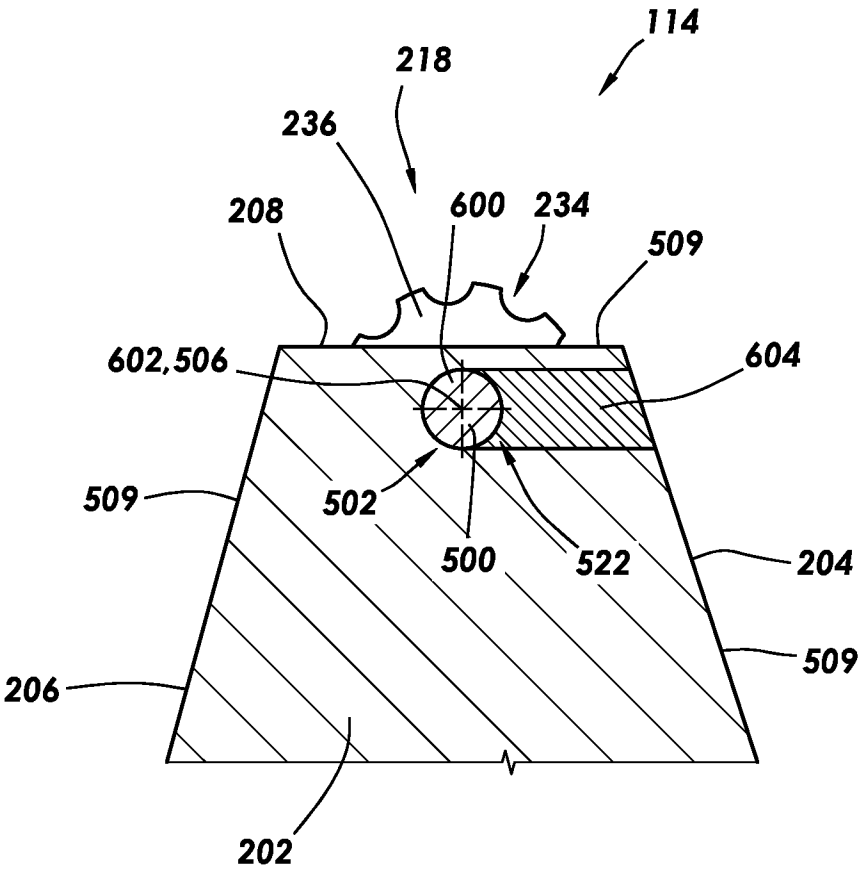
FIG. 7A illustrates a cross-sectional view of the hybrid drill bit further detailing an example of the rolling cutter and the rolling cutter retention mechanism having a pin.

FIG. 7A is a cross-sectional view of the hybrid drill bit 114 further detailing an example of the rolling cutter 218 and the rolling cutter retention mechanism 234 having a pin 500. As set forth above, the pin 500 rotatably couples the rolling cutter 218 to the blade 202 of the hybrid drill bit 114. In particular, the pin 500 rotatably couples the rolling cutter 218 to the rolling-cutter pocket 214 formed in the blade 202. In the illustrated embodiment, the rolling-cutter pocket 214 is formed in the exterior face 208 and the leading face 204 of the blade 202. The rolling-cutter pocket 214 may be sized to receive at least a portion of the rolling cutter 218.

Further, the rolling-cutter pocket 214 includes a pin bore 522 disposed within at least a portion of the rolling-cutter pocket 214 and configured to receive the pin 500. The pin bore 522 extends into opposing first 528 and second 530 sides of the rolling-cutter pocket 214 from an outer surface 509 of the blade 202. In the illustrated embodiment, the pin bore 522 extends through the leading face 204 of the blade 202 and into the opposing first 528 and second 530 sides of the rolling-cutter pocket 214 from The pin 500 may include the solid pin body 600 positioned within the pin bore 522. The pin 500 engages a portion of the bit body positioned within the pin bore 522 to rotatably couple the rolling cutter within the rolling-cutter pocket 214. That is, at least a portion of the solid pin body 600 is positioned within the axial bore 502 of the roller body 236. The pin 500 extends from the first pin receptacle 562 of the pin bore 522, through the axial bore 502 of the roller body 236, and to the second pin receptacle 564 of the pin bore 522. The roller body 236 rotates around the solid pin body 600, and a central axis 602 of the solid pin body 600 is coaxial with the central axis 506 of the rolling cutter 218.

During installation of the rolling cutter 218, the pin 500 may be inserted through the roller body 236. Moreover, as the rolling-cutter pocket 214 and the pin bore 522 extend through the leading face 204 of the blade 202, the rolling cutter 218 and the pin 500 may slide into the exposed rolling-cutter pocket 214 and pin bore 522 from the leading face 204 of the blade 202. To prevent the pin 500 from falling out of the pin bore 522, the rolling cutter 218 may include the plug 604 inserted into the pin bore 522 between the pin 500 and the leading face 204 of the blade. The plug 604 may be welded or otherwise secured within the pin bore 522.

Figure 8B:
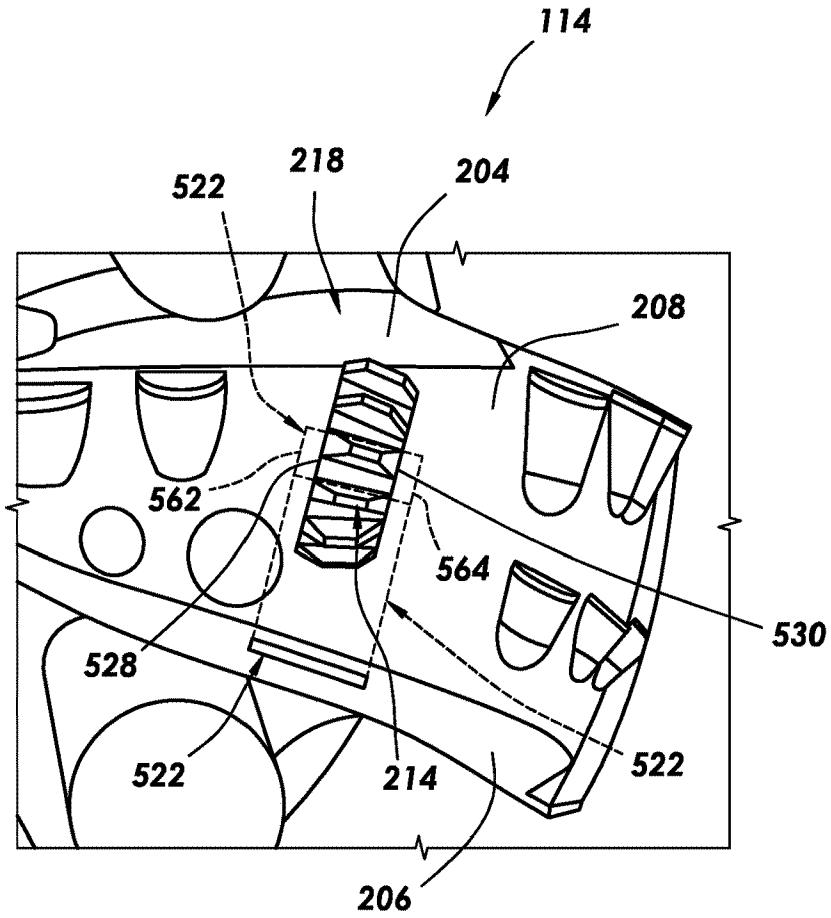
FIG. 8B illustrates a three-dimensional perspective view and the rolling cutter with yet another embodiment of a rolling cutter retention mechanism.
Figure 8A:
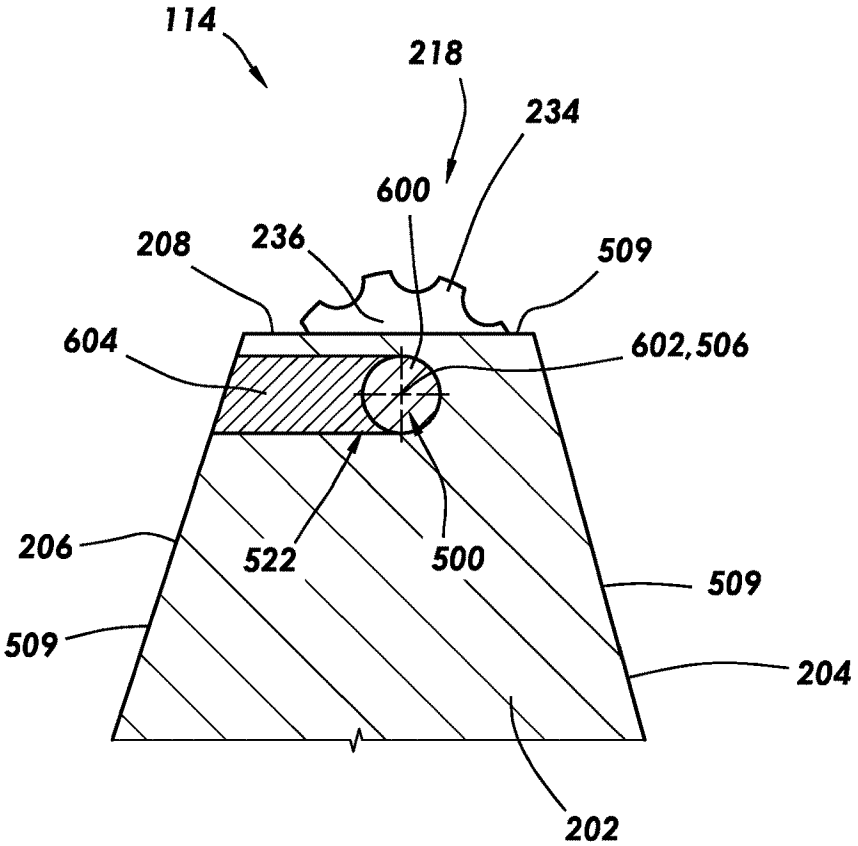
FIG. 8A illustrates a cross-sectional view of the hybrid drill bit further detailing an example of the rolling cutter and the rolling cutter retention mechanism having a pin.

FIG. 7B illustrates a three-dimensional perspective view and the rolling cutter 218 with yet another embodiment of a rolling cutter retention mechanism. As illustrated in FIG. 7A, the rolling cutter 218 includes the pin bore 522 extending through the leading face 208 of the outer surface 509 of the blade 202. The pin 500 is inserted through the roller body 236 and inserted into the pin bore 522 to rotatably couple to the rolling cutter 218 within the rolling-cutter pocket 214. To prevent the pin 500 from falling out of the pin bore 522, the rolling cutter 218 includes the plug 604 inserted into the pin bore 522 between the pin 500 and the leading face 208 of the blade 202. Alternatively, the rolling-cutter pocket 214 and/or the pin bore 522 may extend through the trailing face 206 of the blade 202 as shown in FIGS. 8A and 8B.

Figure 9B:
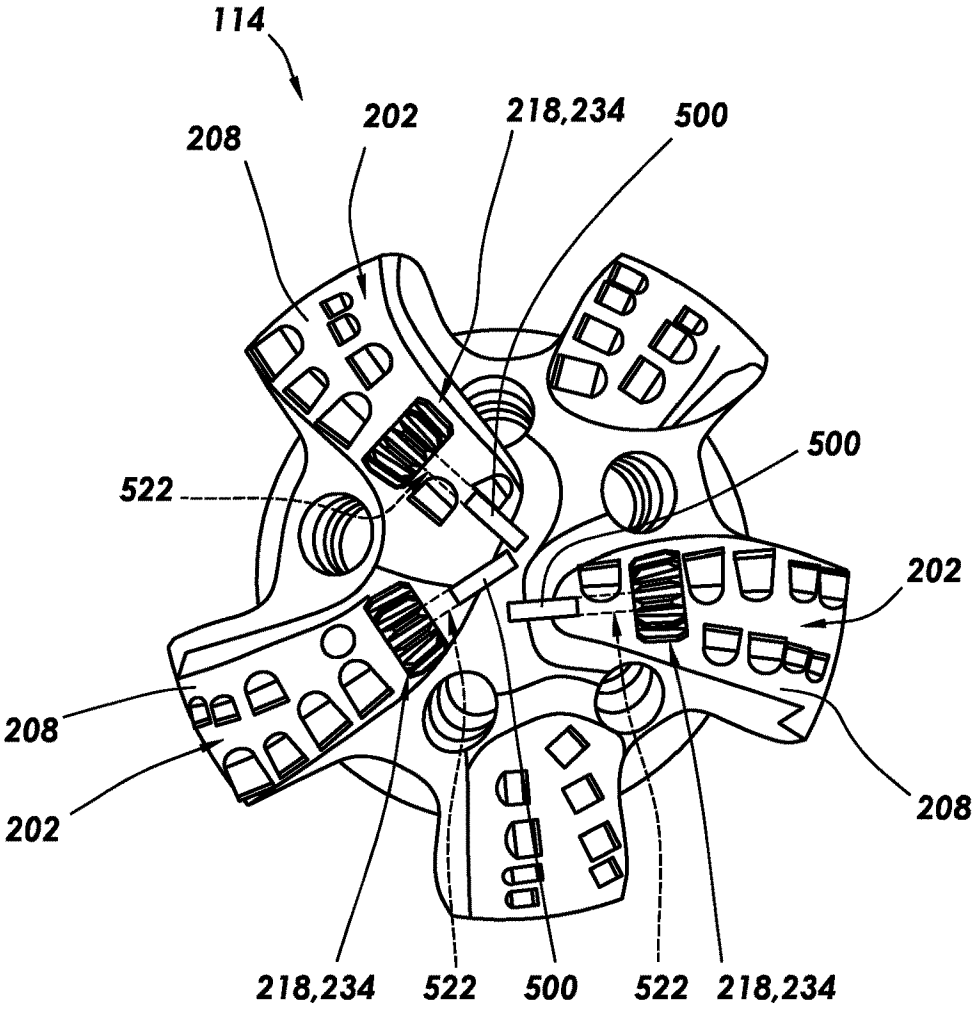
FIG. 9B illustrates a three-dimensional perspective view of the rolling cutter with still another embodiment of a rolling cutter retention mechanism.
Figure 9A:
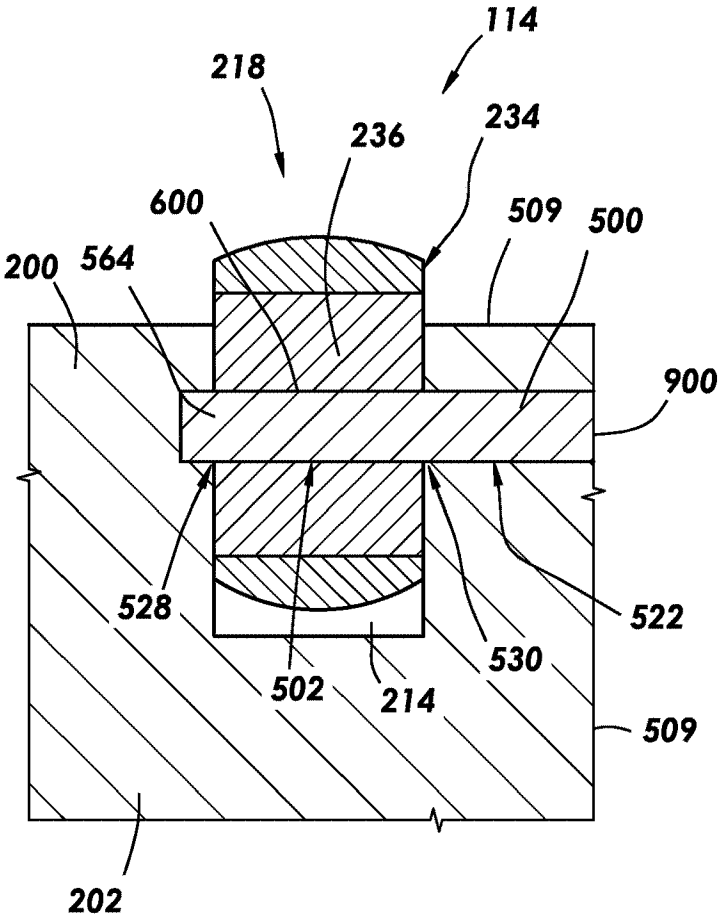
FIG. 9A illustrates a cross-sectional view of the hybrid drill bit further detailing still another example of the rolling cutter and the rolling cutter retention mechanism having a pin.

FIG. 9A is a cross-sectional view of the hybrid drill bit 114 further detailing still another example of the rolling cutter 218 and the rolling cutter retention mechanism 234 having a pin 500. As set forth above, the pin 500 is rotatably coupled the rolling cutter 218 to the blade 202 of the hybrid drill bit 114. In particular, the pin 500 is rotatably coupled the rolling cutter 218 to the rolling-cutter pocket 214 formed in the blade 202. In the illustrated embodiment, the rolling-cutter pocket 214 is formed in the exterior face 208 of the blade 202. The rolling-cutter pocket 214 may be sized to receive at least a portion of the rolling cutter 218.

Further, the rolling-cutter pocket 214 includes a pin bore 522 disposed within at least a portion of the rolling-cutter pocket 214 and configured to receive the pin 500. The pin bore 522 extends through the first 528 side of the rolling-cutter pocket and into the second 530 side of the rolling-cutter pocket 214 from the outer surface 509 of the blade 202 of the bit body 200. In the illustrated embodiment, the pin bore 522 extends through a portion of the exterior face 208 disposed radially interior the rolling-cutter pocket 214.

The pin 500 may include the solid pin body 600 positioned within the pin bore 522. The pin 500 engages a portion of the bit body positioned within the pin bore 522 to rotatably couple the rolling cutter within the rolling-cutter pocket 214. That is, the roller body 236 may be configured to rotate around the solid pin body 600, to the pin 500 extends from a portion of the pin bore 522 proximate the portion of the exterior face 208 disposed radially interior the rolling-cutter pocket 214, through the axial bore 502 of the roller body 236, and to the second pin receptacle 564 of the pin bore 522.

During installation of the rolling cutter 218, the rolling cutter 218 may be inserted into the rolling-cutter pocket 214. While the rolling cutter 218 is disposed within the rolling-cutter pocket 214, the pin 500 may be inserted into the pin bore 522 from the portion of the exterior face disposed radially interior the rolling-cutter pocket 214, at least partially pass through the axial bore 502 of the roller body 236, and engage the second pin receptacle 564 of the pin bore 522. To prevent the pin 500 from falling out of the pin bore 522, a first end 900 of the pin 500 (e.g., the end disposed proximate the portion of the exterior face disposed radially interior the rolling-cutter pocket 214) may be welded or otherwise secured within the pin bore 522. Alternatively, the plug 604 (as best shown in FIG. 7B) may be inserted into the pin bore 522 between the pin 500 and the portion of the exterior face 208 of the blade 202 disposed radially interior the rolling-cutter pocket 214 to secure the pin 500 within the pin bore 522. As set forth above, the plug 604 may be welded or otherwise secured within the pin bore 522.

FIG. 9B illustrates a three-dimensional perspective view of the rolling cutter 218 with still another embodiment of a rolling cutter retention mechanism. As illustrated in FIG. 9A, the rolling cutter includes the pin bore 522 that extends through the portion of the exterior face 208 disposed radially interior the rolling-cutter pocket 214. The pin 500 is inserted into the pin bore and slides through the roller body 236 to rotatably couple to the rolling cutter within the rolling-cutter pocket 214. To prevent the pin 500 from falling out of the pin bore 522, the rolling cutter 218 includes the plug 604 inserted into the pin bore 522 between the pin 500 and the portion of the exterior face 208 disposed radially interior the rolling-cutter pocket 214.

As set forth in detail above, FIGS. 5A-9B disclose various examples of the rolling cutter 218 that may be used with the hybrid drill bit 114 of FIG. 2. These examples show various systems and/or methods for attaching the rolling cutter to the hybrid drill bit. However, it should be understood that other suitable techniques may be used for attaching the rolling cutter to the hybrid drill bit. For example, 3D printing technology may be used to print a hybrid drill bit with the roller cut assembly attached.

Accordingly, embodiments of the preceding description provide a hybrid drill bit having rolling cutter on a fixed-cutter type drill bit, for example, to reduce breakage, delamination, or other wear of fixed-cutter, which may extend an operational life of the drill bit. The systems, methods, and apparatus may include any of the various features disclosed herein, including one or more of the following statements.

Statement 1. A hybrid drill bit may comprise a bit body having a plurality of fixed cutters disposed thereon and at least one rolling-cutter pocket; a rolling cutter rotatably positioned within the rolling-cutter pocket on the bit body, the rolling cutter including a roller body with an axial bore and a plurality of teeth arranged around the roller body to engage a subterranean formation; and a rolling cutter retention mechanism including a pin received within the axial bore of the rolling cutter, the pin engaging the bit body to rotatably couple the rolling cutter within the rolling-cutter pocket in the bit body.

Statement 2. The hybrid drill bit of statement 1, wherein the pin includes least one axially moveable plunger moveably disposed within at least one pin receptacle defined by the bit body within the rolling-cutter pocket of the bit body.

Statement 3. The hybrid drill bit of statement 1 or statement 2, wherein the pin includes a hollow pin body received within the rolling-cutter pocket, and first and second axially moveable plungers moveably disposed within the hollow pin body.

Statement 4. The hybrid drill bit of any one of statements 1-3, wherein the pin includes a biasing mechanism to bias the first and second axially movable plungers in axially opposing directions into engagement with the opposing pin receptacles, the opposing pin receptables being defined by the bit body within the rolling-cutter pocket of the bit body.

Statement 5. The hybrid drill bit of any one of statements 1-4, wherein the biasing mechanism includes a compression spring.

Statement 6. The hybrid drill bit of any one of statements 1-5, wherein the bit body includes a plurality of blades, and wherein the rolling-cutter pocket is disposed on at least one blade of the plurality of blades.

Statement 7. The hybrid drill bit of statements 1-6, wherein the rolling-cutter pocket is formed in an exterior face of the blade, a leading face of the blade, or a trailing face of the blade.

Statement 8. The hybrid drill bit of statements 1-7, further comprising a pin bore extending from an outer surface of the bit body into opposing sides of the rolling-cutter pocket, wherein a plug is disposed in the pin bore to secure the pin in the rolling-cutter pocket.

Statement 9. The hybrid drill bit of statements 1 and 6-8, wherein the pin includes a solid pin body.

Statement 10. The hybrid drill bit of statements 1-8, wherein the pin includes a hollow pin body for receiving at least one axially movable plunger.

Statement 11. The hybrid drill bit of statements 1-8 and 10, wherein the pin includes a biasing mechanism to bias the at least one axially movable plunger axially outward from at least one end of the pin into engagement with the bit body.

Statement 12. The hybrid drill bit of statements 1-11, wherein the rolling cutter is positioned in a leading position on the bit body and a fixed cutter of the plurality of fixed cutters is positioned in a trailing position on the bit body, wherein the rolling cutter engages a portion of the subterranean formation, and wherein the fixed cutter engages the portion of the subterranean formation engaged by the rolling cutter.

Statement 13. The hybrid drill bit of statements 1-12, wherein the rolling cutter is positioned within a cone area of the bit body.

Statement 14. The hybrid drill bit of statements 1-13, The hybrid drill bit of claim 1, wherein the rolling cutter supports at least a portion of a weight-on-bit and provides depth-of-cut control.

Statement 15. A method of forming a hybrid drill bit comprising coupling a plurality of fixed cutters to a bit body; and coupling a rolling cutter at least partially within a rolling-cutter pocket formed in the bit body with a rolling cutter retention mechanism, the roller cutter retention mechanism including a pin extending through an axial bore of the rolling cutter and engaging the bit body to rotatably couple the rolling cutter to the bit body within the rolling-cutter pocket, the rolling cutter including a roller body with the axial bore and a plurality of teeth arranged around the roller body to engage a subterranean formation.

Statement 16. The hybrid drill bit of statement 15, wherein coupling the rolling cutter at least partially within the rolling-cutter pocket includes axially retracting at least one movable plunger of the pin into a hollow pin body of the pin, inserting the rolling cutter into a rolling-cutter pocket formed in the bit body, and axially extending the at least one movable plunger to engage the pin with at least one pin receptacle defined by the bit body within the rolling-cutter pocket of the bit body.

Statement 17. The hybrid drill bit of statements 15 and 16, wherein axially extending the at least one movable plunger includes biasing the at least one movable plunger outwardly from the hollow pin body via a biasing mechanism having a compression spring.

Statement 18. The method of statements 15-17, wherein axially extending the at least one movable plunger includes biasing first and second movable plungers outwardly in opposing directions to respectively engage opposing pin receptacles via a biasing mechanism positioned between the first and second movable plungers within the hollow pin body.

Statement 19. The method of statements 15-18, wherein coupling the rolling cutter at least partially within the rolling-cutter pocket includes inserting the pin into the rolling-cutter pocket through a pin bore extending from an outer surface of the bit body and through a first side of the rolling-cutter pocket to an opposing side of the rolling-cutter pocket, the pin being inserted into the pin bore from the outer surface of the bit body and engaging the opposing side of the rolling-cutter pocket.

Statement 20. The method of statements 15-19, wherein coupling the rolling cutter at least partially within the rolling-cutter pocket further includes inserting a plug into the pin bore to secure the pin in the rolling-cutter pocket. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A hybrid drill bit, comprising:

a bit body having a plurality of blades with a plurality of fixed cutters disposed thereon, and wherein each blade of the plurality of blades comprises at least one rolling-cutter pocket positioned between adjacent fixed cutters along the respective blade;

a plurality of rolling cutters, wherein each rolling cutter of the plurality of rolling cutters is rotatably positioned within a corresponding rolling-cutter pocket, wherein each rolling cutter includes a roller body with an axial bore and a plurality of teeth arranged around the roller body to engage a subterranean formation, and wherein each rolling cutter of the plurality of rolling cutters is disposed at a unique radial position or distance from a central axis of the bit body such that each rolling cutter follows a unique cutting path as the bit body rotates; and a plurality of rolling cutter retention mechanisms, wherein each rolling cutter retention mechanism includes a pin received within the respective axial bore of a corresponding rolling cutter, the pin engaging the bit body to rotatably couple the corresponding rolling cutter within the corresponding rolling-cutter pocket in the bit body.

2. The hybrid drill bit of claim 1, wherein the pin includes at least one axially moveable plunger moveably disposed within at least one pin receptacle defined by the bit body within the corresponding rolling-cutter pocket of the bit body.

3. The hybrid drill bit of claim 1, wherein each rolling-cutter pocket is formed in an exterior face of the respective blade, a leading face of the respective blade, or a trailing face of the respective blade.

4. The hybrid drill bit of claim 1, further comprising a pin bore extending from an exterior face of an outer surface of a respective blade of the plurality of blades and into opposing sides first and second sides of a corresponding rolling-cutter pocket, wherein the pin bore is configured to receive the pin, and wherein at least one plug is disposed in the pin bore to secure the pin in the corresponding rolling-cutter pocket.

5. The hybrid drill bit of claim 4, wherein the pin includes a solid pin body.

6. The hybrid drill bit of claim 4, wherein the pin includes a hollow pin body that receives at least one axially movable plunger.

7. The hybrid drill bit of claim 6, wherein the pin includes a biasing mechanism to bias the at least one axially movable plunger axially outward from at least one end of the pin into engagement with the bit body.

8. The hybrid drill bit of claim 4, wherein the at least one plug comprises a first plug and a second plug, wherein the first plug is disposed in the pin bore proximate the first side of the corresponding rolling-cutter pocket to secure a first end of the pin within the pin bore, and wherein the second plug is disposed in the pin bore proximate the second side of the corresponding rolling-cutter pocket to secure a second end of the pin within the pin bore.

9. The hybrid drill bit of claim 1, wherein each rolling cutter of the plurality of rolling cutters is positioned in a leading position on a respective unique cutting path and at least one corresponding fixed cutter of the plurality of fixed cutters is positioned in a trailing position on the respective unique cutting path, wherein each rolling cutter engages a portion of the subterranean formation, and wherein the at least one corresponding fixed cutter engages the portion of the subterranean formation engaged by the corresponding rolling cutter.

10. The hybrid drill bit of claim 1, wherein a rotational axis of the roller body is oriented inward toward a rotational axis of the drill bit.

11. The hybrid drill bit of claim 10, wherein the rotational axis of the roller body is perpendicular with a tangential direction of movement of the roller body about the rotational axis of the drill bit.

12. The hybrid drill bit of claim 1, wherein each tooth of the plurality of teeth spans an axial length of the roller body.

13. The hybrid drill bit of claim 1, wherein each rolling-cutter pocket is formed in an exterior face of the respective blade, wherein each rolling-cutter pocket comprises a first side defined by a radially interior portion of the respective blade, a second side defined by a radially exterior portion of the respective blade, a leading side defined by a leading portion of the respective blade, and a trailing side defined by a trailing portion of the respective blade.

14. A hybrid drill bit, comprising:

a bit body having a plurality of fixed cutters disposed thereon and at least one rolling-cutter pocket;

a rolling cutter rotatably positioned within the rolling-cutter pocket on the bit body, the rolling cutter including a roller body with an axial bore and a plurality of teeth arranged around the roller body to engage a subterranean formation; and a rolling cutter retention mechanism including a pin received within the axial bore of the rolling cutter, the pin engaging the bit body to rotatably couple the rolling cutter within the rolling-cutter pocket in the bit body, wherein the pin includes a hollow pin body received within the rolling-cutter pocket, and first and second axially moveable plungers moveably disposed within the hollow pin body.

15. The hybrid drill bit of claim 14, wherein the pin includes a biasing mechanism to bias the first and second axially movable plungers in axially opposing directions into engagement with opposing pin receptacles defined by the bit body within the rolling-cutter pocket of the bit body.

16. The hybrid drill bit of claim 15, wherein the biasing mechanism includes a compression spring.

17. A method of forming a hybrid drill bit, comprising:

coupling a plurality of fixed cutters to one or more blades on a bit body; and coupling a rolling cutter at least partially within a rolling-cutter pocket formed in the bit body between adjacent fixed cutters along a respective one of the blades with a rolling cutter retention mechanism, the roller cutter retention mechanism including a pin extending through an axial bore of the rolling cutter and engaging the bit body to rotatably couple the rolling cutter to the bit body within the rolling-cutter pocket, wherein coupling the rolling cutter at least partially within the rolling-cutter pocket includes axially retracting at least one movable plunger of the pin into a hollow pin body of the pin, inserting the rolling cutter into the rolling-cutter pocket, and axially extending the at least one movable plunger to engage the pin with at least one pin receptacle defined by the bit body within the rolling-cutter pocket, wherein axially extending the at least one movable plunger includes biasing the at least one movable plunger outwardly from the hollow pin body via a biasing mechanism having a compression spring, the rolling cutter including a roller body with the axial bore and a plurality of teeth arranged around the roller body to engage a subterranean formation.

18. The method of claim 17, wherein axially extending the at least one movable plunger includes biasing first and second movable plungers outwardly in opposing directions to respectively engage opposing pin receptacles via a biasing mechanism positioned between the first and second movable plungers within the hollow pin body.

19. The method of claim 17, wherein coupling the rolling cutter at least partially within the rolling-cutter pocket includes inserting the pin into the rolling-cutter pocket through a pin bore extending from an outer surface of the bit body and through a first side of the rolling-cutter pocket to an opposing side of the rolling-cutter pocket, the pin being inserted into the pin bore from the outer surface of the bit body and engaging the opposing side of the rolling-cutter pocket.

20. The method of claim 19, wherein coupling the rolling cutter at least partially within the rolling-cutter pocket further includes inserting a plug into the pin bore to secure the pin in the rolling-cutter pocket.

* * * * *